United States Patent [19]

Petersen et al.

[11] Patent Number: 4,944,416

[45] Date of Patent: Jul. 31, 1990

[54] LIGHT-WEIGHT SLOT-WALL DISPLAY PANEL

[76] Inventors: Robert J. Petersen, 9789 SE. 41st St., Mercer Island, Wash. 98040; Marvin C. Lemmerman, 2234 SE. 8th Pl., Renton, Wash. 98055

[21] Appl. No.: 273,837

[22] Filed: Nov. 21, 1988

[51] Int. Cl.[5] ..... A47F 5/00

[52] U.S. Cl. ..... 211/87; 211/94; 248/220.2; 248/222.2

[58] Field of Search ..... 211/94, 87, 189, 59.1; 248/220.2, 222.2, 220.3; 108/901

[56] References Cited

U.S. PATENT DOCUMENTS

| | | | |
|---|---|---|---|
| 3,861,326 | 1/1975 | Brown | 108/901 X |
| 3,951,078 | 4/1976 | Fowler et al. | 108/901 X |
| 4,159,681 | 7/1979 | Vandament | 108/901 X |
| 4,211,379 | 7/1980 | Morgan et al. | 248/222.2 |
| 4,240,557 | 12/1980 | Dickens | 211/153 |
| 4,615,448 | 10/1986 | Johnstonbaugh | 211/87 X |
| 4,629,076 | 12/1986 | Amstutz et al. | 211/87 X |

*Primary Examiner*—Robert W. Gibson, Jr.
*Attorney, Agent, or Firm*—Dowrey, Cross & Cole

[57] ABSTRACT

A light-weight slotted panel for mounting merchandising accessories on the front face thereof. The panel is formed from a high density light-weight core composed of molded-board expanded plastic foam and is provided with a front facing sheet laminated thereto. Parallel slots are formed in both the core and facing sheet and configured to accept compatible merchandising accessories.

20 Claims, 2 Drawing Sheets

LIGHT-WEIGHT SLOT-WALL DISPLAY PANEL

BACKGROUND OF THE INVENTION

1. Field of the Invention:

The present invention relates to merchandising display walls and more particularly to a construction known generally as slot-wall. This invention relates to the manner of constructing such slot-walls and the composition of the materials used in that construction.

During the decade of the 1980's retail stores in the United States embraced slot-wall merchandising techniques in such numbers that it is now difficult to find a recent installation which does not employ it in some fashion. The slot-wall technique is utilized in both self-service and over-the-counter merchandising. A successor to "peg-board", the new merchandising panel is considered far more attractive while remaining as practical and serviceable.

2. Description of the Prior Art:

By far the most widely used material for the manufacture of slot-wall is medium density fiber-board (MDF). U.S. Pat. Nos. to Amstutz, et al No. 4,591,058 and Johnstonbaugh No. 4,615,448 disclose well known examples of fiber-board and particle-board construction.

Usually, panels measuring 4 feet wide and 8 feet long and ¾ of an inch thick are utilized. Parallel channels are milled or routed straight across one dimension (usually the 8 foot dimension) and are spaced on equal centers over the surface. The routed channels or "slots" form the female receptacle for display accessories or brackets having cooperating male appendages. The slots are uniformly sized throughout the industry and can readily be reinforced by form-fitting inserts extruded from plastic or aluminum should increased load-bearing capacity be required by the end user. Because of the brittleness of fiber-board and particle board, the use of extruded plastic inserts has become more the rule than the exception. The panels come paint-ready, but, usually are faced with a decorative plastic laminate. When positioned vertically or stacked, they convert immediately into a display wall. Attractive and efficient slot-wall plays host to an endless array of accessories, brackets and hangers designed to display anything a merchant might require.

In spite of its wide spread usage, fiber-board slot-wall is nevertheless much criticized. It is heavy and it is fragile, given the stresses to which it is inevitably subjected. Those familiar with the product are aware that, by its nature, the fiber-board is extremely brittle and rigid. A single panel usually weighs approximately 85 pounds and, coupled with its large ungainly size, the panel is difficult to handle. Since the panels are milled to be stackable (a major selling point), the panels have half-slots on each longitudinal edge necessitating minimum thickness of material precisely where one would want the maximum thickness in order to absorb impact from handling. Further, if picked up carelessly a panel can even fail under the stress of its own weight along the routed slots since it has no bending strength Thus, great pains must be taken during handling and shipping of the product. Crating must be extensive, freight costs are staggering and damage claims and work stoppages are common place throughout the industry. To add to the problem, when slot strength is in question, the cost of channel reinforcements is substantial given the linear footage required to fill the slots in each panel. Other attempts at slot-wall construction have met with similar problems or have been too expensive or complex to gain general acceptance. The U.S. Pat. No. to Breakey, No. 4,572,381 for instance discloses a type of slot-wall utilizing plywood paneling. A base board and face panel are laminated and then grooves precision cut in the facing panel. The U.S. Patent No. to Radek, No. 4,607,753 shows still another type of slot-wall utilizing sheet metal or sheet plastic. In this regard, attempts to develop sheet or "board" plastics as a core material have included extruded closed cell polyvinyl chloride (PVC) foam. This construction, of course, results in not only a more complex system but is extremely expensive to manufacture and assemble and hence has not received wide acceptance in the industry. The cost of extruded PVC, for instance, is prohibitive for most users.

Another problem common to the use of fiber-board or other moisture permeable wood product for constructing the slot-wall, is that of warpage. In most circumstances where a panel is subjected to a different ambient moisture content on its opposed faces warpage will occur. When one face is painted or laminated an unbalanced moisture exposure is created. This problem is heightened by the fact that, after being milled, the cross-section is irregular with relatively thin-walled longitudinal areas. If left freestanding for any period of time, in fact, warpage will inevitably occur.

SUMMARY OF THE INVENTION

Considering the foregoing, the present invention provides a slot-wall construction which retains for the merchant the economies and function of fiber-board and other types of slot-wall with all its attendant accessories and, at the same time, eliminates as much as possible the negative factors thereof. The present invention provides a novel and extremely light-weight and inexpensive slot-wall construction wherein the main body or core of the panel comprises a molded expanded high density polystyrene foam or its equivalent. The core can be described as being a "molded-board" since the material is expanded in a closed form or mold under controlled heat and pressure conditions. Once the beads are expanded, the foam cells are compressed into the desired form and at the desired high density. It has been discovered that panels provided with a relatively high density facing, adhesively secured to the expanded molded board high density foam core, perform in most respects superior to the widely accepted fiber-board construction of the prior art. The outstanding physical properties of expanded high density foam plastic including light weight, controllable compressibility, good shear strength and flexibility or bending strength are utilized to overcome the deficiencies of prior art products. When the front and/or the back faces of the expanded high density foam core are provided with laminates such as thin plywood (sometimes referred to as doorskin), high pressure laminates such as FORMICA or other thin hard surface plastic in sheets adhesively bonded thereto, the resulting slot-wall panel is capable of sustaining a surprising amount of vertical loading. The loading capability of the high density foam core panel of the present invention is comparable to or exceeds that possible with prior art fiber-board slot-wall. These unobvious results coupled with cost factors and the greatly improved shipping and handling ability of the light weight but tough high density foam core panels open the door for even more widespread and universal utility of slot-wall merchandising as it is known today.

For most merchandising the high density foam core slot-wall of the present invention is well within the realm of practicality and certainly comparable to fiber-board construction which now enjoys the most widespread use. For merchandising of such articles as video or other tape cassettes for instance, the high density foam core wall is ideal. The cassette boxes are displayed to the customer for making the purchase or rental choice. Often cassettes themselves are stored on shelves away from the display area. The advantages of light weight high density foam core slot-wall panels in this instance are easily assessed. When utilized for more substantial loading the high density foam core slot-wall may be provided with light or heavy gauge plastic or even sheet metal inserts in a well known manner, again making the wall comparable or better than fiber-board walls. The high density foam core may be milled to accept the common insert configuration which is standard in the industry.

Depending upon the choice of surface laminates, more than half the weight of the present fiber-board product is eliminated. The savings in shipping costs alone are highly significant and in some instances critical to the use or non-use of slot wall. Since the expanded high density foam core is less brittle and less fragile than fiber-board, little or no damage is experienced in shipping. The light weight high density core is, in fact, flexible to a great degree and is far easier to handle, especially when provided with a suitable laminate face. Since the expanded high density plastic foam is impervious to moisture, no warping occurs.

The T-slots or channels normally used in slot-wall are routed in the molded board high density foam core and will receive either plastic or metal extruded channels if needed for further load bearing capacity. It has been found that the molded board high density foam core is adaptable to conventional manufacturing methods such as milling or routing to form the channels without damage to the core material from heat or cutting action. In a well known manner, the expanded high density foam core is first laminated front and/or back with the desirable laminate and is then routed or milled along with the facing laminate to form the longitudinal channels.

DESCRIPTION OF THE PREFERRED EMBODIMENTS

Figure 1:
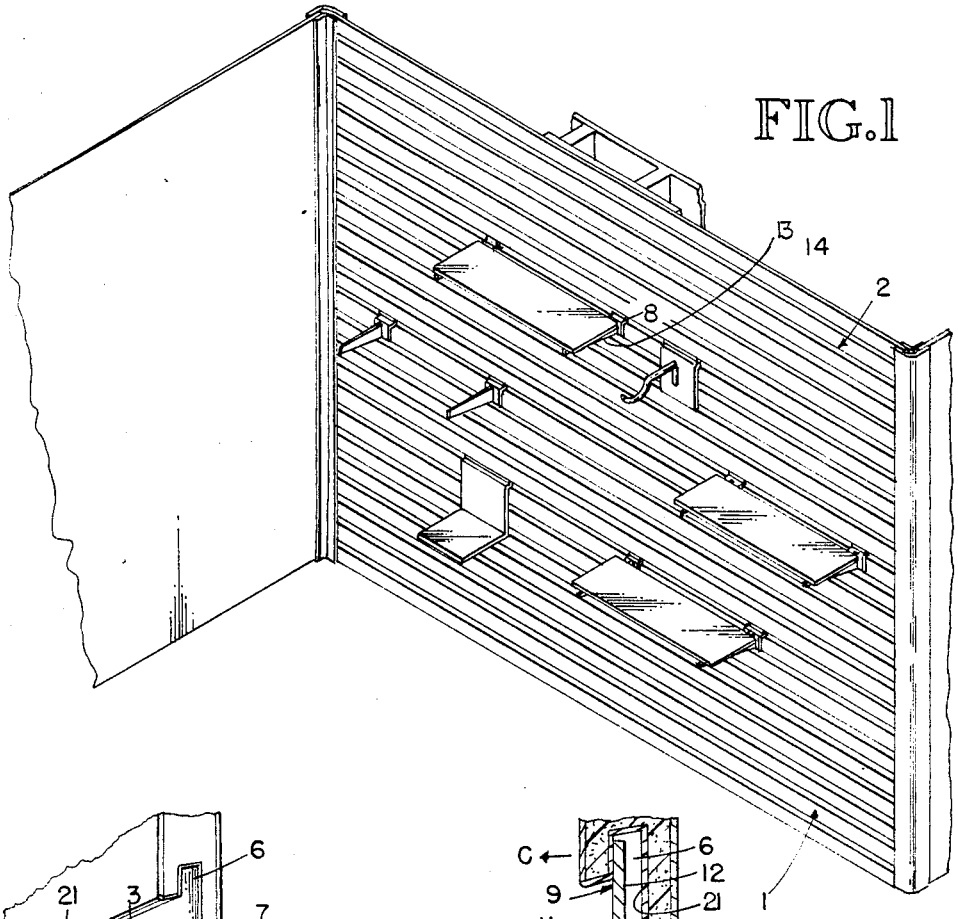
FIG. 1 is a perspective view of a typical slot-wall display installation according to the present invention.
Figure 2:
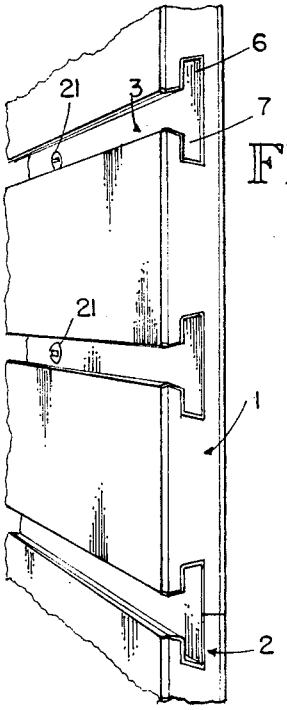
FIG. 2 is a partial perspective view of the end detail of a slot-wall installation.
Figure 3:
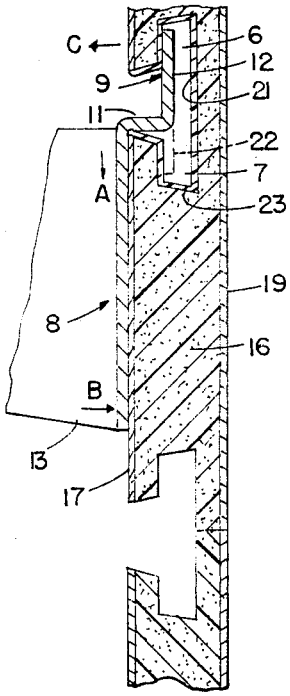
FIG. 3 is a vertical cross-section of a slotted panel showing the mounting detail for a typical slot-wall accessory.

FIG. 1 illustrates the manner in which conventional slot-wall panels are vertically stacked with their horizontal parallel grooves presenting the female slot configuration for the reception of accessories such as cantilevered shelf arms, brackets, modular trays and the like. Normally the slot-wall panels such as the panels 1 and 2 are 4 by 8 feet in dimension with two such panels covering all or part of the wall space from floor to ceiling. Although the slot-wall panels 1 and 2 in FIG. 1 are illustrated as being applied to a conventional 2×4 stud and wallboard construction, it will be understood by those conversant in the art that they may be attached to any wall surface. Freestanding double-sided or single-sided panels may also be erected for display purposes according to many commercially available systems. As illustrated in FIG. 2, the horizontal slots 3 are of a general T configuration having a horizontal opening 4 and vertical arms 6 and 7. The usual accessory attaching means is in the form of a plate 8 as indicated in FIG. 3 which includes an angular seating portion 9 which has horizontal and vertical legs 11 and 12 respectively. As may be seen in FIG. 3, the horizontal leg 11 extends into the slot, rests upon the lower lip of the slot and the leg 12 extends upwardly into the vertical arm 6 of the T-slot. Although the configuration illustrated is fairly standard, it will be understood by those skilled in the art that the exact cross-sectional configuration of the slots or grooves in the panels may vary somewhat depending upon the manufacturer and the system design.

As shown in FIG. 3, the attaching plate 8 is connected to a cantilevered arm or shelf support 13 and may cooperate with one or more additional attaching means to support a shelf . It will also be noted that, although the width of the plate and seating portion may vary, it should have considerable width for the purpose of distributing the load along a length of the slot depending upon the load which the attachment means is designed to support. Referring to FIG. 1, for instance a hook or rod like support 14 would normally be attached to a hanger plate for the purpose of distributing the load along the slot as opposed to the point-load application of a rod inserted in the T-slot. The width of the support plate also gives the accessory lateral stability. It will also be understood that the bottom vertical arm 7 of the slot is designed to alternatively accommodate a downwardly vertically extending leg such as the leg 22 shown in dotted lines as attached to the support plate.

FIG. 3 illustrates the distribution of forces occurring during the loading of a cantilevered arm 13 and support plate utilizing the horizontal and vertical legs 11 and 12 respectively. As indicated by the arrows in FIG. 3, the general downward weight of the bracket and load is directed along the arrow a edgewise on the panel face. The loading on the outward end of the arm 13, however, creates an inwardly directed horizontal force b bearing against the face of the panel and a second horizontal force in the direction of the arrow c bearing against the top lip of the T-slot. These forces result in the tendency to rotate the cantilevered arm about the lower edge of the plate 8.

Figure 4:
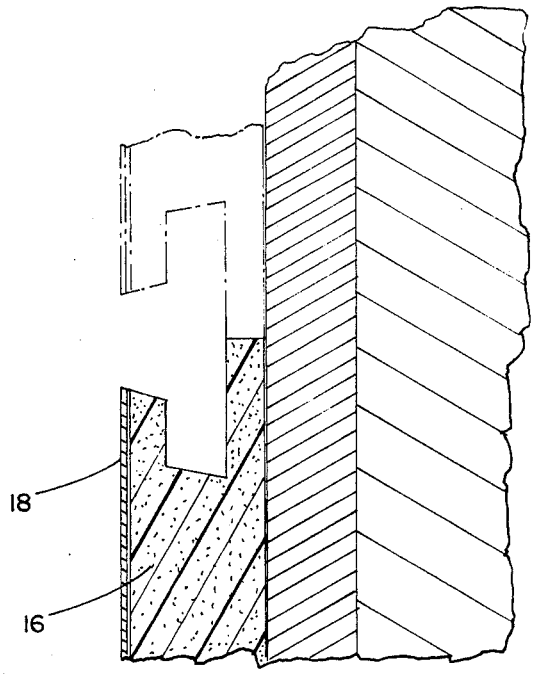
FIG. 4 a vertical cross-section of a modification of the slot-wall panel according to the present invention.

As illustrated in FIGS. 3 and 4, the slot-wall panel of the present invention has for its main structural member a core 16 which is characterized as being extremely lightweight compared to prior art panels formed from fiber-board or plywood and yet of a high-density so as to possess the necessary physical properties to function as a support member for slot-wall accessories. The high density core 16 may be provided with a suitable face laminate such as the facing sheet 17 shown in FIG. 3 or a thin plywood face such as the facing 18 shown in the FIG. 4 embodiment. The high density core 16 may be utilized with or without a backing sheet such as the backing sheet 19 show in the FIG. 3 embodiment. Referring to the FIG. 3 embodiment, the facing sheet 17 may comprise what is known as a high pressure laminate such as those commercially available and sold under the trademark FORMICA. Although the high pressure laminate may add considerable weight to the otherwise lightweight panel, it may be chosen for design reasons or for the extremely durable surface presented by the laminate. This may be true for instance in the situation where metal accessories are to be attached to the slot-wall. The backing sheet 19 may also comprise a high pressure laminate, of course, with no necessity for decorative finish. The backing sheet could comprise any plastic sheeting desired and would serve to supply additional strength and protection to the back surface of the core member 16 when needed. As shown in FIG. 3, the core 16 with its back face can be applied directly to wall board or any other existing wall surface usually with the aid of well-known building adhesives. In addition, screw members 21 may be utilized at selected positions on the face of the panel and located within the grooves 3 in order to more securely fasten the panel to a wall surface if this is desirable. Screw heads should be seated either on the surface of groove inserts or provided with suitable washers on the high density foam surface.

FIG. 4 represents an alternative embodiment of the slot wall panel utilizing the light weight high density core 16 laminated with a face 18 comprised of extremely thin plywood. The plywood 18 is sometimes referred to in the industry as "doorskin" because of its use in the manufacture of hollow core doors. This material is usually 3-ply and normally does not exceed ⅛ of an inch in thickness. The plywood laminate 18 may be utilized when a decorative wood surface is desired and would be chosen for those uses wherein the decorative wood surface would not be damaged by the slot wall accessories. FIG. 4 illustrates an embodiment wherein the backing sheet of FIG. 3 is eliminated and the high density core 16 is attached directly to an existing wall or other structural backing such as a freestanding panel. In the FIG. 4 embodiment, the individual slot-wall panels may be adhesively secured directly to the structural support.

The core member 16 of the present invention is comprised of high density polystyrene which is a rigid closed-cell cellular foamed plastic. The high density core is in the form of a board which is formed in a mold under extreme heat and pressure in a manner familiar in the art of foamed plastic manufacture. The high density polystyrene molded-board is manufactured under controlled heat and pressure conditions to attain the proper density and has physical properties including shear, compressive, tensile and flexural strength which are dependent upon its density. In order to attain the increased density, the plastic beads are caused to expand in the usual manner and then mechanically compressed before they are allowed to cure. The result is a closed cell tightly compacted structure which, when cured, and unlike fiber-board, is not hygroscopic and subject to warpage. The density range suitable for use with the present invention is within the range of 3–6 pounds per cubic foot (pcf) which is a relatively high density compared to other uses of expanded foamed polystyrene (EPS) such as cushioning and thermal insulation. The optimum range for these common uses is from 1 to 1.2 pounds pcf. Optimum density for thermal insulation is approximately 2.0 pcf. It has been discovered, however, that high density polystyrene foam molded at the range of 3–6 pcf demonstrates optimum physical properties for slot-wall construction in terms of compression, shear, tensile and flexural strength. The preferred material for use in the present invention is a 5 pcf molded-board cellular foamed polystyrene. The polystyrene high density foam core 16 of the present invention may be attached to wall surfaces as well as its facing sheets by the use of any one of a multitude of construction adhesives as long as the adhesive does not contain a solvent which will attack the polystyrene foam. While there are a host of solvents such as chlorinated and aromatic hydrocarbons which will attack the polystyrene, the lower aliphatic alcohols and glycols exert little or no solvent action on polystyrene. The spray contact adhesive sold under the brand name BOND WELL C-1003, manufactured by Weller White Chemical Co. of Torrence, Calif. has been used with success in laminating materials on the face of the high density polystyrene core. Another commercially available adhesive which has also given good results is sold under the brand name ISOSET, manufactured by Ashland Chemical Co., Midland, Penna. This product is a water soluble two-part adhesive.

It has been found that polystyrene core of the density range described may be routed or milled successfully without damage either by heat or abrasion in the manufacture of slot-wall configurations. The manufacturing method of first laminating a face sheet, such as the FORMICA or plywood doorskin described, directly on the surface of the molded-board high density core panel and then milling or routing the T-shaped cross-section parallel slots the length of the panel may be utilized. Although with some limitations, the panel may be made of varying thicknesses but usually will be in the neighborhood of ¾ to 1 inch in thickness. It is normally desirable to keep the board thickness below approximately 2 inches in thickness to ensure proper and complete curing of the foam material in order to maintain its dimensional stability. As illustrated in FIG. 3, the slots 3 may be fitted with commercially available slot-wall reinforcing inserts 22 which are inserted longitudinally into the slots and may extend the length of the panel if desired. The inserts 23 are available in either plastic or metal extrusions and may vary substantially in their thickness and strength. If loading requirements dictate the use of inserts, the inserts will be chosen as the loading requirements dictate. Normally with such lightweight items as video or other tape cassettes or lightweight sundries there will be no need for inserts.

The extremely lightweight, high density and strength properties of molded-board polystyrene foam cores result in a panel which is as much as 50% lighter than commonly used fiber-board slot wall panels. As may well be appreciated, the shipping cost of the panels of the present invention is drastically reduced making the slot-wall merchandising method available to small businesses that would not otherwise be able to afford the cost. Likewise, shipment damage to the lightweight panels can be nearly eliminated since the polystyrene foam core is inherently tougher and more flexible than the rigid and brittle fiber-board now in use.

The present invention has been described and illustrated with respect to specific embodiments thereof. It will be apparent to those skilled in the art, however, that modifications to the structure as described may be made without departing from the spirit of the invention or from the scope of the appended claims.

What is claimed is:

1. A slotted panel for display of merchandise of all types detachably mounted on a surface thereof comprising:

a flat board shaped core member having substantially planar front and back opposing faces with a plurality of spaced substantially parallel longitudinal grooves opening into said front face, said back face being adapted for attachment to a substantially vertical support surface, said grooves being configured to accept and support hanger accessories thereon for supporting brackets cantilevered from said front face, and said core member comprising molded-board expanded plastic foam having a density of from 3–6 pounds per cubic foot.

2. The panel of claim 1 wherein said molded-board plastic foam has a density of 5 pounds per cubic foot.

3. The panel of claim 2 wherein said molded-board plastic foam comprises polystyrene.

4. A slotted panel for display of merchandise of all types detachably mounted on a surface thereof comprising:

a flat board shaped core member having front and back substantially planar faces with a plurality of spaced parallel longitudinal grooves opening into said front face, said back face being adapted for attachment to a substantially vertical surface, said grooves having at least one horizontal arm and one vertical arm and being configured to accept hanger accessories thereon for supporting brackets cantilevered from said front face, and relatively thin load supporting face strip adhesively bonded to and covering said front face between said grooves, said core member comprising molded-board expanded plastic foam having a density of from 3–6 pounds per cubic foot.

5. The panel of claim 3 wherein said molded-board plastic foam has a density of 5 pounds per cubic foot.

6. The panel of claim 4 wherein said molded-board plastic foam comprises polystyrene.

7. A display panel for merchandise of all types detachably mounted on a surface thereof comprising;

a substantially vertical board shaped core member having a substantially planar face with at least one opening therein, said at least one opening being configured to accept and support a hanger accessory mounted therein, and a thin face-laminate adhesively bonded to said front face and having edges coextensive with the edges of said at least one opening, said core member comprising a lightweight expanded plastic foam material, said face laminate comprising a rigid sheet material having a greater density and lesser thickness than said core material, whereby said hanger accessory is vertically supported by the coextensive edges of said rigid face-laminate and the sheer strength of the bond between the core and the face-laminate, said face-laminate providing bearing surfaces for resisting rotational forces exerted by said hanger accessory.

8. The panel of claim 7 wherein said core member comprises a high density molded plastic foam.

9. The panel of claim 8 wherein said core member has a density of 3–6 pounds per cubic foot.

10. The panel of claim 8 wherein said core member has a density of 5 pounds per cubic foot.

11. The panel of claim 9 wherein said core has a thickness range of $\frac{3}{4}$–1 inch.

12. The panel of claim 11 wherein said core comprises polystyrene plastic.

13. The panel of claim 8 wherein said face-laminate comprises a high pressure laminate sheet such as FORMICA or the like.

14. The panel of claim 9 wherein said face-laminate comprises a high pressure laminate sheet such as FORMICA or the like.

15. The panel of claim 11 wherein said face-laminate comprises a high pressure laminate sheet such as FORMICA or the like having a thickness in the neighborhood of $\frac{1}{8}$ inch or less.

16. The panel of claim 11 wherein said face-laminate comprises a plywood sheet having a thickness in the neighborhood of 150 inch or less.

17. The panel of claim 13 wherein said planar face comprises a front face, said core including a back substantially planar face opposing said front face, rigid vertical panel support means, said back face being fixed to said rigid vertical panel support means.

18. The panel of claim 7 wherein said at least one opening comprises an elongated groove.

19. The panel of claim 18 wherein said core member includes a plurality of said grooves arranged in substantially parallel relation and extending in a substantially horizontal direction, said grooves being formed in said panel by milling or routing after said face-laminate is adhesively bonded to the front face of said core.

20. The panel of claim 17 wherein said core member includes a plurality of said grooves arranged in substantially parallel relation and extending in a substantially horizontal direction, said grooves being formed in said panel by milling or routing after said face-laminate is adhesively bonded to the front face of said core.

* * * * *